US005596793A

United States Patent [19]

Davis

[11] Patent Number: 5,596,793

[45] Date of Patent: Jan. 28, 1997

[54] ABRASION RESISTANT SLIDE FASTENER

[76] Inventor: Gary T. Davis, 230 Saddletree Rd., Oxford, N.C. 27565

[21] Appl. No.: 391,962

[22] Filed: Feb. 21, 1995

[51] Int. Cl.[6] ..... A44B 19/12

[52] U.S. Cl. ..... 24/394; 24/397

[58] Field of Search ..... 24/391, 398

[56] References Cited

U.S. PATENT DOCUMENTS

| | | | |
|---|---|---|---|
| 3,456,306 | 7/1969 | Heimberger . | |
| 3,783,476 | 1/1974 | Frohlich . | |
| 3,964,135 | 6/1976 | Heimberger | 24/394 |

FOREIGN PATENT DOCUMENTS

| | | | |
|---|---|---|---|
| 889735 | 2/1962 | United Kingdom | 24/394 |

*Primary Examiner*—James R. Brittain
*Attorney, Agent, or Firm*—Rosenthal & Putterman

[57] ABSTRACT

An abrasion resistant slide fastener includes a coupling element attached to a support tape by stitching looper and needle threads to secure the coupling element and a filler cord, extending through the coupling element, to a support tape. The looper thread has an upper portion which engages an upper shank of the coupling element and a lower portion which engages the needle thread within the filler cord. The needle thread is stitched at a greater tension than the looper thread and secures the looper thread, the coupling element and the filler cord to the support tape. The upper portion of the looper thread, engaging the upper shank, is heated until it melts from the upper shank of the coupling element, thus eliminating the looper thread exposed to wear and forming anchor portions which engage the filler cord. The needle thread and the lower portion of the looper thread are not directly exposed to the heat source and remain substantially intact within the filler cord. The anchor portions are drawn toward the interior of the filler cord due to the greater tensioning of the needle thread, which secures the coupling element to the support tape and produces an abrasion resistant slide fastener.

6 Claims, 3 Drawing Sheets

ABRASION RESISTANT SLIDE FASTENER

FIELD OF THE INVENTION

This invention relates in general to an abrasion resistant slide fastener and to a method of attaching an abrasion resistant slide fastener coupling element to a support tape by looper and needle stitching threads which are not exposed to wear.

BACKGROUND OF THE INVENTION

A conventional slide fastener stringer comprises a pair of slide fastener stringer halves having a continuous helical coil or meandering coupling element attached to a longitudinal edge of a support tape and adapted to engage or disengage a complementary coupling element of another support tape. The coupling element has a plurality of turns or spirals relatively closely spaced apart along the edge of the tape and generally projecting laterally along the edge.

Typically, the coupling element has coupling heads which engage coupling heads of the complementary coupling element to prevent separation of the coupling element in the absence of a slider, which couples and decouples the elements. The coupling element may be continuous and may comprise helically coiled turns of monofilament thermoplastic joined along the longitudinal edge of the support tape. Each turn forms a coupling head receivable between the turns of the complementary coupling element.

Various techniques have been proposed for securing the coupling elements to the support tapes: 1) stitching the coupling element to the support tape with a row of chain or lock stitches, 2) clamping the coupling heads of each individual turn of the coupling element to the edge of the tape by crimping or similar techniques, and 3) thermally welding or adhesively bonding a continuous coil coupling element to the support tape.

Typically, a filler cord extends along an inner opening of the coupling element for engaging the thread that loops over the upper shank of each spiral to secure the coupling element to the support tape. However, the thread along the upper shank is exposed to slider wear and foreign object abrasion which causes the thread to break. When the thread breaks, the coupling element disengages from the support tape and the slide fastener fails.

An attempt to solve this problem utilizes an indentation along the upper shank of each turn to protect the thread from slider and foreign object wear. For example, U.S. Pat. No. 3,783,476 of Frohlich, issued Jan. 8, 1974, discloses coupling elements having an indentation for engaging the thread below the exposed surface of the coupling element's upper shank, thereby partially protecting the thread from the slider and from foreign object abrasion. However, the thread is not completely protected since it is still partially exposed along the outer surface of the coupling element's upper shank. In addition, Frohlich requires specialized coupling elements having a specific indentation, thereby increasing the complexity of the coupling elements' manufacturing process. Furthermore, the indentation must be smooth to ensure that the thread does not encounter abrasion from the indentation itself. Also, the thread must be properly centered so as to shrink within the indentation during the heat shrink process. Otherwise, a portion of the thread will remain exposed and defeat the indentation's function. In addition, the thread may be over-heated during the heat shrink process and break, causing total failure of the slide fastener.

Another attempt at a solution to the abrasion problem is disclosed in U.S. Pat. No. 3,456,306 of Heimberger, issued Jul. 22, 1969. Heimberger discloses melting the looper thread for the purpose of increasing the coupling element's ability to withstand stress. However, Heimberger is careful to point out that the looper thread is melted in "formfitting relationship" to the coupling element, i.e., is not melted completely away from the upper shank. Therefore, the looper thread remains on the upper shank, exposed to slider wear and foreign object abrasion. In addition, Heimberger states that the looper and needle threads are melted together "to form a nonseparable fastening means capable of withstanding high stress and even forming a substantially continuous member for guiding the slider". Therefore, Heimberger uses the portion of the looper and needle threads which are melted together to form a guide on which the slider travels. Thus, the Heimberger slide fastener encourages slider abrasion of the looper thread. The slider abrasion problem of Heimberger is further increased because the needle and looper thread have approximately the same tension level. Therefore, the non-melted portion of the looper thread remains in an exposed position above the filler cord after the melting process.

In summary, Heimberger teaches away from eliminating slider abrasion by disclosing the melted portion being used as a guide for the slider. Heimberger further discloses the looper thread "about" the coupling element to produce "a ridge along which the slider can ride". At least a portion of the looper thread of Heimberger remains on the upper shank of the coupling element resulting in such portion of the looper thread being exposed to increased slider wear. Therefore, the Heimberger slide fastener is not abrasion resistant and appears to be actually less capable of withstanding abrasion than a conventional slide fastener.

SUMMARY OF THE INVENTION

It is an object of the present invention to provide an improved abrasion resistant slide fastener having a coupling element attached to a support tape in such a way as to anchor each turn or spiral of the coupling element to the support tape while preventing interference with a slide fastener slider or foreign object by eliminating the looper thread exposed to wear.

It is a further object of the present invention to provide an improved method of producing an abrasion resistant slide fastener, including the steps of stitching a looper and needle thread having upper and lower looper portions to a coupling element with the upper looper portion overlying an upper shank of the coupling element. A filler cord is positioned in and extends through the coupling element. A needle thread is stitched through the support tape with a lower needle thread portion engaging the support tape and an upper needle thread portion engaging the filler cord and overlying the lower looper thread portion. This secures the looper thread, the coupling element and the filler cord to the support tape. A greater tension is applied to the needle thread than the looper thread whereby the upper needle portion and the lower looper portion are drawn toward the interior of the filler cord. The upper looper portion is melted from the upper shank of the coupling element while the remaining ends of the looper thread are formed into anchors which engage the filler cord for anchoring the looper thread and the needle thread to the filler cord. The upper needle portion and the lower looper portion are drawn within the filler cord by the greater tension of the needle thread and remain substantially intact while the anchors are also drawn toward the interior of the filler cord.

In carrying out the above and other objects of the invention, there is provided an abrasion resistant slide fastener having a support tape, coupling element, filler cord, looper and needle threads and anchoring means. The coupling element has a plurality of spirals each of which have upper and lower shanks. The lower shank of the coupling element is positioned along the support tape for interengagement with a complimentary coupling element. The filler cord is positioned within and extends through the plurality of spirals of the coupling element. The looper thread has upper and lower looper portions stitched to the coupling element with the upper looper portion overlying the upper shank of the coupling element. The needle thread has upper and lower needle portions with the lower needle portion stitched through the support tape. The upper needle portion is stitched through the filler cord and overlies the lower looper portion, thereby securing the looper thread, the coupling element and the filler cord to the support tape. The needle thread is stitched under a greater tension than the looper thread whereby the lower looper portion engages the filler cord and the upper looper portion is drawn toward the filler cord by the greater tension of the needle thread. Anchoring means are formed by melting the upper looper portion from the upper shank of the coupling element. The anchoring means engages the filler cord while the upper needle portion overlies and holds the midportions of the lower looper portion substantially in the interior of the filler cord after the upper portion is melted from the upper shank which forms the anchoring means at the ends of the lower looper portion and anchors the looper thread and the needle thread to the filler cord against the greater tension of the needle thread.

DETAILED DESCRIPTION OF THE INVENTION

Figure 2:
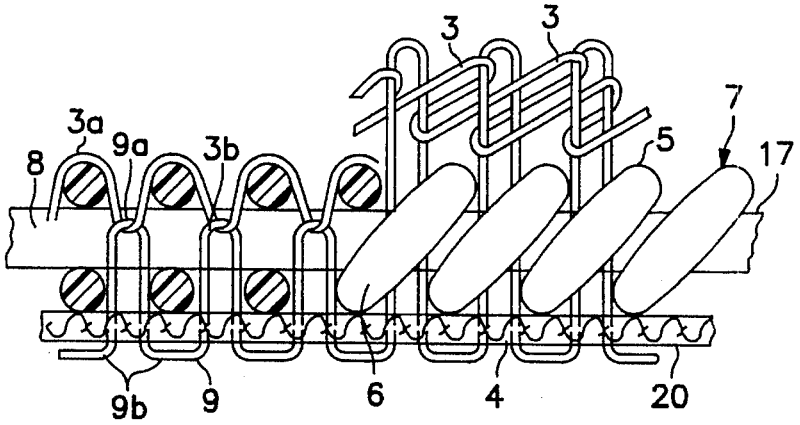
FIGS. 2 and 3 are sectional views of FIG. 1 taken along lines II—II and III—III, respectively, showing the interlocking of the lower looper third portion and the upper needle thread portion of the present invention prior to melting.
Figure 3:
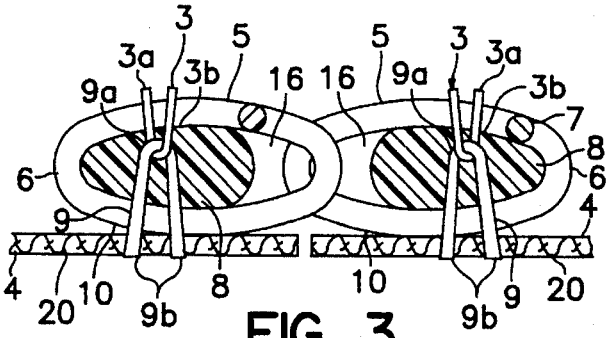
Figure 1:
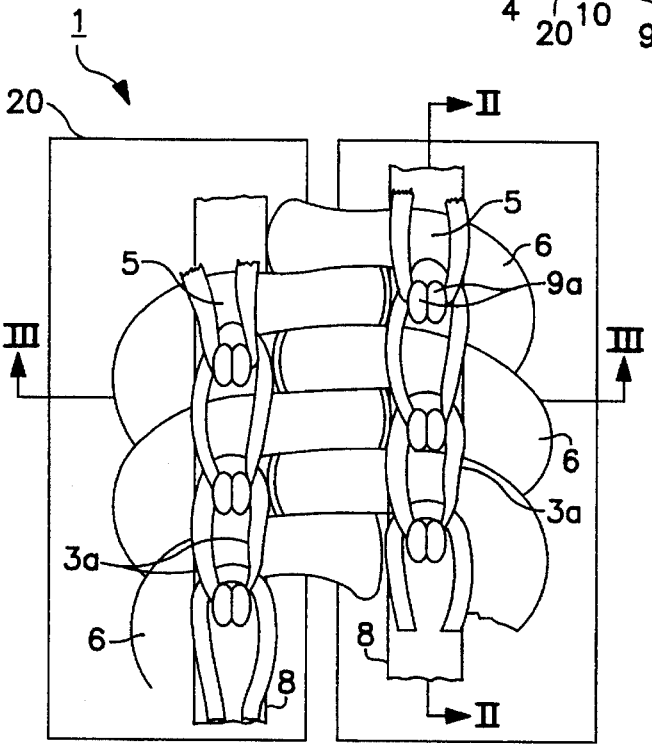
FIG. 1 is a top view of an engaged slide fastener prior to the melting of the upper looper thread portion from the coupling element's upper shank of the present invention.

Referring to FIGS. 1–3, a slide fastener 1 is shown prior to the preferred melting process and comprises a pair of slide fastener stringer halves 20, each having a coupling element 7 which interengages a complementary coupling element upon movement of a slider (not shown) along the coupling element. The coupling element 7 has a plurality of individual spirals 6 each of which have upper and lower shanks 5, 10. Looper thread 3 has an upper looper portion 3*a* that overlies upper shank 5 of coupling element 7 and a lower looper portion 3*b* that curls tinder an upper needle portion 9*a* of a needle thread 9 substantially at the midpoint of lower looper portion 3*b*. Needle thread 9 passes through a filler cord 8 which extends longitudinally through openings 16 of spirals 6 as a lower needle portion 9*b* is stitched to a support tape 4, thereby securing looper thread 3, coupling element 7 and filler cord 8 to support tape 4. Coupling element 7 is preferably a continuous, helical coil (FIG. 4) but may comprise a meandering coupling element (FIG. 1) composed of individual turns or spirals without deviating from the intent of the invention.

In assembling the preferred slide fastener, a greater tension is applied to needle thread 9 than to looper thread 3. Thus upper needle portion 9*a*, which is stitched to lower looper portion 3*b*, is drawn toward the interior of filler cord 8 due to the greater tension of needle thread 9. Lower looper portion 3*b* is thus drawn into the filler cord 8, below a top surface 17 of filler cord 8, while upper looper portion 3*a* remains exposed.

Figure 6:
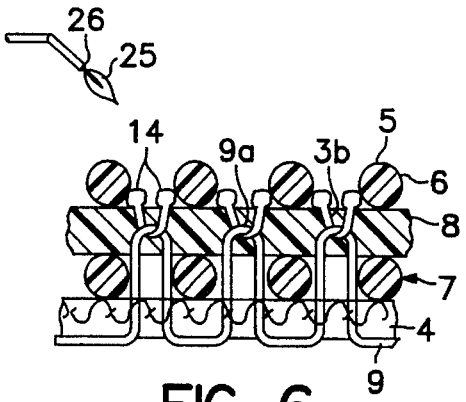
FIG. 6 is a sectional view of FIG. 4 taken along line IV—IV after the melting of the upper looper portion showing the anchors formed at the ends of the lower looper portion of the present invention.
Figure 5:
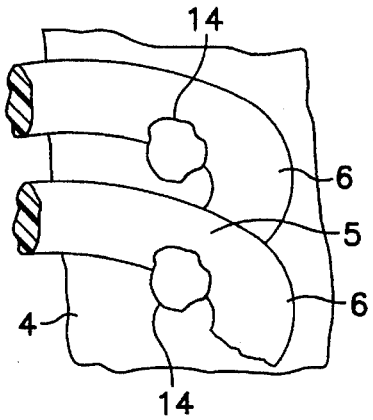
FIG. 5 is a sectional view of a slide fastener showing the anchors formed after the upper looper thread portion is melted from the upper shank of the present invention.
Figure 4:
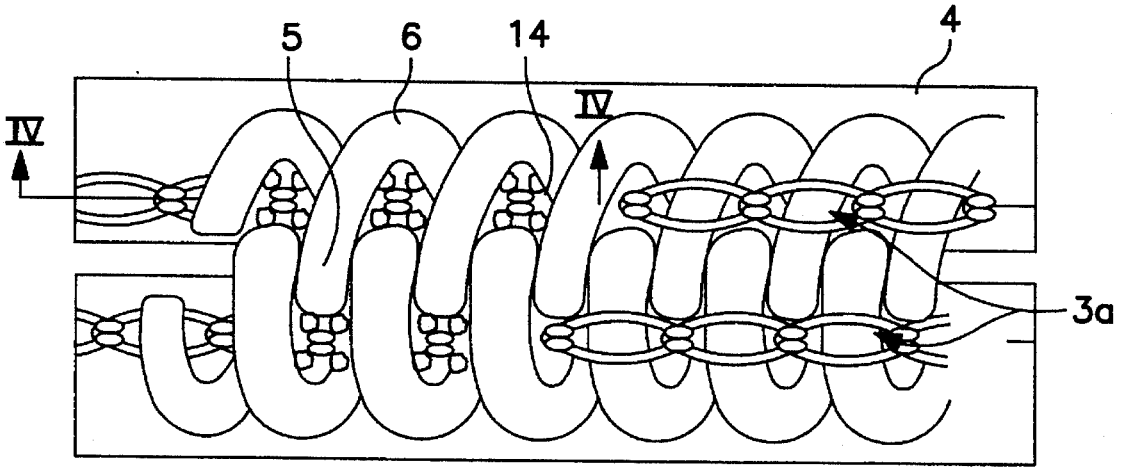
FIG. 4 is a top view of a side fastener during the melting of the upper looper thread portion of the present invention.

Referring to FIGS. 4–6, a preferred heat source 25 comprises a gas flame which melts upper looper portion 3*a* from upper shank 5. However, upper looper portion 3*a* may be melted from upper shank 5 in a variety of ways without deviating from the intent of the invention. Upon exposure of upper looper portion 3*a* to gas flame 25 sufficient for melting, upper looper portion 3*a* will melt from upper shank 5 and form an anchor 14 at the ends of lower looper portion 3*b* (FIG. 6). An anchor 14 is formed on each side of upper shank 5 along top surface 17 of filler cord 8. Thus, upper looper portion 3*a* is eliminated from upper shank 5 and cannot sustain slider wear or foreign object abrasion which are the principle failure factors for this type of slide fastener.

When upper looper portion 3*a* is melted and forms anchors 14, lower looper portion 3*b* and the ends of portion 3*b*, in the form of anchors 14, are drawn into the interior of filler cord 8 due to needle thread 9 having a greater tension than looper thread 3. As lower looper portion 3*b* is drawn into filler cord 8 (FIGS. 5 and 6), anchors 14 are also drawn into the interior of filler cord 8 and held securely in place by the tension from needle thread 9.

Anchors 14 are formed for securing coupling element 7 and filler cord 8 to support tape 4 while at the same time providing the advantageous result of eliminating upper looper portion 3*a* from upper shank 5, and more importantly, avoiding damage resulting from wear caused by movement of the slider or from foreign objects. Thus, slide fastener 1 is, according to the invention, abrasion resistant without reducing its structural integrity.

Looper and needle threads 3, 9 and filler cord 8 are preferably composed of thermoplastic synthetic resin (e.g. polyamide or polyester). However, needle thread 9 and filler cord 8 may comprise a non-thermoplastic synthetic resin without deviating from the intent of the invention since in the preferred embodiment, only upper looper portion 3*a* is melted to form anchors 14. Furthermore, upper needle portion 9*a* and/or filler cord 8 may be thermally fused by a heat source 25 (FIG. 6) with lower looper portion 3*b* and/or coupling element 7 without deviating from the intent of the invention.

Figure 7:
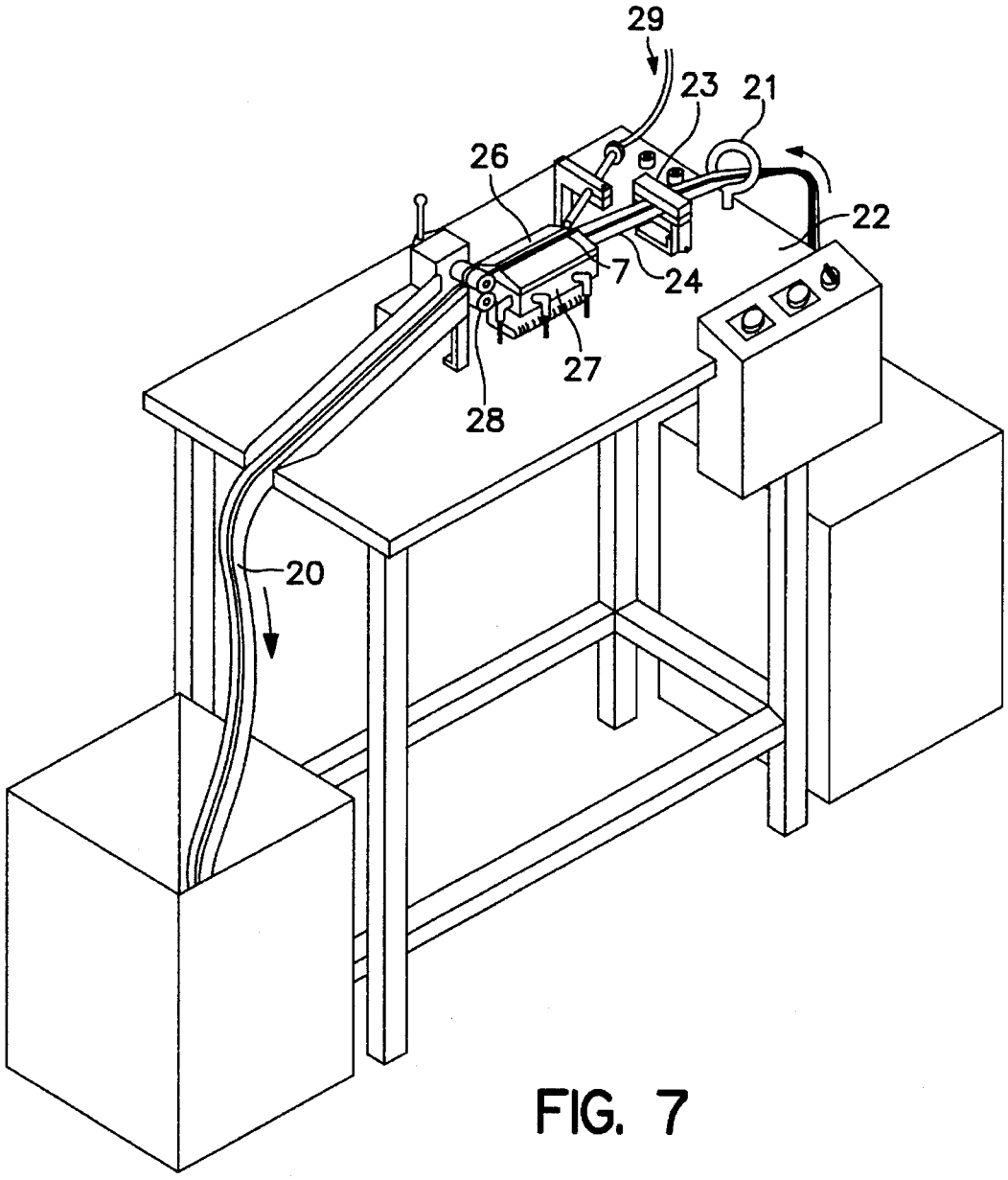
FIG. 7 illustrates the preferred process for melting the upper looper portion of the present invention.

Referring to FIG. 7, the steps of melting upper looper portion 3*a* from upper shank 5 of coupling element 7 and the forming of anchors 14, are illustrated. Preferably, slide fastener stringer 20 is threaded through a guide ring 21, which is attached to surface 22 and provides initial alignment of stringer 20 into an electronic fault detector 23 through a melting die positioner 27 and to a pair of motor driven drums 28 which move stringer 20 along a path 24. Fault detector 23 preferably comprises an electronic safety which shuts off motors 28 and gas flame 25 if stringer 20 misfeeds or is absent.

Upper looper portion 3*a* is fed along positioner 27 of path 24 to gas flame 25, preferably supplied by natural gas 29 and set at a temperature sufficient to melt the upper looper portion 3*a* from the upper shank 5. Positioner 27 preferably comprises a water chilled steel die designed to position stringer 20 the appropriate distance from gas flame 25 and protect stringer 20 from damage caused by over-exposure to flame 25. Gas flame 25 is delivered from a nozzle tip 26 to enable upper looper portion 3*a* to be melted away from upper shank 5 of coupling element 7 with the melted material forming anchor portions 14 anchoring to filler cord 8. Lower looper portion 3*b*, which is threaded under upper needle portion 9*a*, is protected from direct exposure to gas flame 25 due to the lower looper portion 3*b* being drawn into the interior of filler cord 8 by the greater tension of the needle thread 9. Therefore, needle thread 9, having a greater tension than looper thread 3, acts on lower looper portion 3*b* to draw portion 3*b* into the interior of filler cord 8 as upper looper portion 3*a* is melted by the heat of gas flame 25. It will be seen that needle thread 9 and lower looper portion 3*b* remain substantially intact within filler cord 8 during the melting process as needle thread 9 and lower looper portion 3*b* are drawn away from gas flame 25 and substantially protected.

Preferably thermal melting is accomplished by gas flame 25; however, thermal melting of upper looper portion 3*a* can be carried out in a variety of ways without deviating from the intent of the invention. For example, a radial heating device or a dielectric heater can melt upper looper portion 3*a* thereby forming anchor portions 14. Other known heating techniques may also be used. Since the thickness of threads 3, 9 is substantially less than filler cord 8 or coupling element 7, thermoplastic threads 3, 9 will flow (melt) before coupling element 7 or filler cord 8 have had an opportunity to flow. The mid-portion of the anchoring structure, i.e. lower looper portion 3*b*, is even further protected from the heat of the heat source 25 by being located under portion 9*a* of the needle thread 9. The integrity of the anchoring structure 14, 3*b*, 14 is, therefore, safeguarded.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. An abrasion resistant slide fastener, comprising:

a support tape;

a coupling element having a plurality of spirals each of which have upper and lower shanks, said coupling element positioned along said support tape for interengagement with a complementary coupling element;

a filler cord positioned within and extending through said plurality of spirals of said coupling element;

a looper thread having upper and lower looper portions stitched to said coupling element with said upper looper portion overlying said upper shank of said coupling element;

a needle thread having upper and lower needle portions with said lower needle portion stitched through said support tape, said upper needle portion stitched through said filler cord and overlying said lower looper portion, thereby securing said looper thread, said coupling element and said filler cord to said support tape, said needle thread being stitched under a greater tension than said looper thread whereby said lower looper portion engages said filler cord and said upper looper portion is drawn toward said filler cord by said greater tension of said needle thread; and anchoring means formed by melting and severing said upper looper portion from said upper shank of said coupling element thereby forming a plasticized end of greater diameter than the lower looper portion, said anchoring means engaging said filler cord, said upper needle portion overlying and holding the midportions of said lower looper portion substantially in the interior of said filler cord after said upper portions melted from said upper shank forming anchoring means at the ends of said lower looper portion for anchoring said looper thread and said needle thread to said filler cord against said greater tension of said needle thread.

2. The slide fastener of claim 1, wherein said coupling element comprises a continuous helical coil.

3. The slide fastener of claim 2, wherein said continuous helical coil comprises a thermoplastic synthetic resin.

4. The slide fastener of claim 1, wherein at least one of said filler cord and said needle thread comprises a thermoplastic synthetic resin.

5. The slide fastener of claim 1, wherein said looper thread comprises a thermoplastic synthetic resin.

6. The slide fastener of claim 1, wherein said needle thread is stitched at a tension level approximately 10% greater than the tension level at which said looper thread is stitched.

* * * * *